United States Patent [19]

Mullins

[11] 4,421,184

[45] Dec. 20, 1983

[54] ROCK BIT WITH IMPROVED SHIRTTAIL VENTILATION

[75] Inventor: John M. Mullins, Houston, Tex.

[73] Assignee: Hughes Tool Company, Houston, Tex.

[21] Appl. No.: 327,525

[22] Filed: Dec. 4, 1981

[51] Int. Cl.[3] ..... E21B 10/22

[52] U.S. Cl. ..... 175/337; 175/339; 175/371

[58] Field of Search ..... 175/337, 339, 340, 371, 175/322; 384/92, 93, 94, 95, 96

[56] References Cited

U.S. PATENT DOCUMENTS

| | | | |
|---|---|---|---|
| 1,758,773 | 5/1930 | Zublin | 175/337 |
| 1,758,814 | 5/1930 | Zublin | 175/337 |
| 3,720,274 | 3/1973 | McCallum | 175/372 |
| 3,935,911 | 2/1976 | McQueen | 175/372 |
| 4,280,571 | 6/1981 | Fuller | 175/337 |
| 4,359,113 | 11/1982 | Morris | 175/372 |

*Primary Examiner*—Stephen J. Novosad
*Assistant Examiner*—William P. Neuder
*Attorney, Agent, or Firm*—Robert A. Felsman; James E. Bradley

[57] ABSTRACT

An earth boring bit of the air cooled bearing type has features to improve cleaning of the borehole. The bit has three bit legs, each with a depending bearing pin that receives a rotatable cutter. Bearings are located between the bearing pin and the cutter. Passages communicate drilling fluid from the drill string to the bearings. A slot between the bit leg and the backface of the cutter enables air to be discharged from the bearing pin into the borehole. The portion of the slot on the lower side of the bearing pin is greater in cross-sectional flow area than the portion on the upper side. The portion of the slot on the lower side exposes the outer ends of the roller bearings to the borehole.

5 Claims, 2 Drawing Figures

ROCK BIT WITH IMPROVED SHIRTTAIL VENTILATION

BACKGROUND OF THE INVENTION

This invention relates in general to earth boring bits, an in particular to a bit of the type that utilizes air pumped through its bearings for cooling.

One type of earth boring operation utilizes air as the drilling fluid. Air is pumped down the drill string, where it exits through nozzles in the drill bit. One type of drill bit has three cutters rotatably mounted on bearing pins. As the drill string is rotated, the cutters rotate in their bearing pins to disintegrate the earth. Much of the air passing through the drill string exits through nozzles located between the cutters.

Normally, about one third of the air volume is directed through the bearings for cooling. The bearings include a set of roller bearings located near the back face of the cutter. An annular clearance exists between the bit leg and the backface for discharging air out of the bearings into the borehole. The clearance is larger on the upper side than on the lower side of the bearing pin so that most of the air vents on the upper side of the bearing pin under the bit shroud.

While these bits are successful, cuttings tend to build up around the bit and not be flushed to the surface by the air. This causes wear on the outer diameter of the bit legs of the bit.

SUMMARY OF THE INVENTION

In this invention, the annular slot for discharging air from the bearings is structured so that most of the air will discharge on the lower side of the bearing pin, rather than on the upper side under the shroud, as previously. This is handled by providing a slot with a greater cross-sectional flow area on the lower side than on the upper side. The bearings include a set of roller bearings that are located in a race formed in the cutter. The outer edge of the race intersects the backface. This places the circular outer ends of the roller bearings flush with the backface.

The roller bearings are retained by an annular boss on the bearing pin that extends radially only about one-half the diameter of the roller bearings. The boss terminates in a last machined surface on the upper side of the bearing pin that provides a clearance between the bit leg and the backface of the cutter. The last machined surface is removed from the lower side of the bearing pin, up to the annular boss. This depending portion of the bit leg, or shirttail, results in a clearance between the edge of the race and the shirttail for discharging drilling fluid into the borehole. On the upper side, the last machined surface is of conventional width and leads into a shroud closely spaced from the backface of the cutter to provide a slot of smaller cross-sectional dimension. This forces most of the air out the lower side for enhanced cleansing of cuttings.

DESCRIPTION OF THE PREFERRED EMBODIMENT

Figure 1:
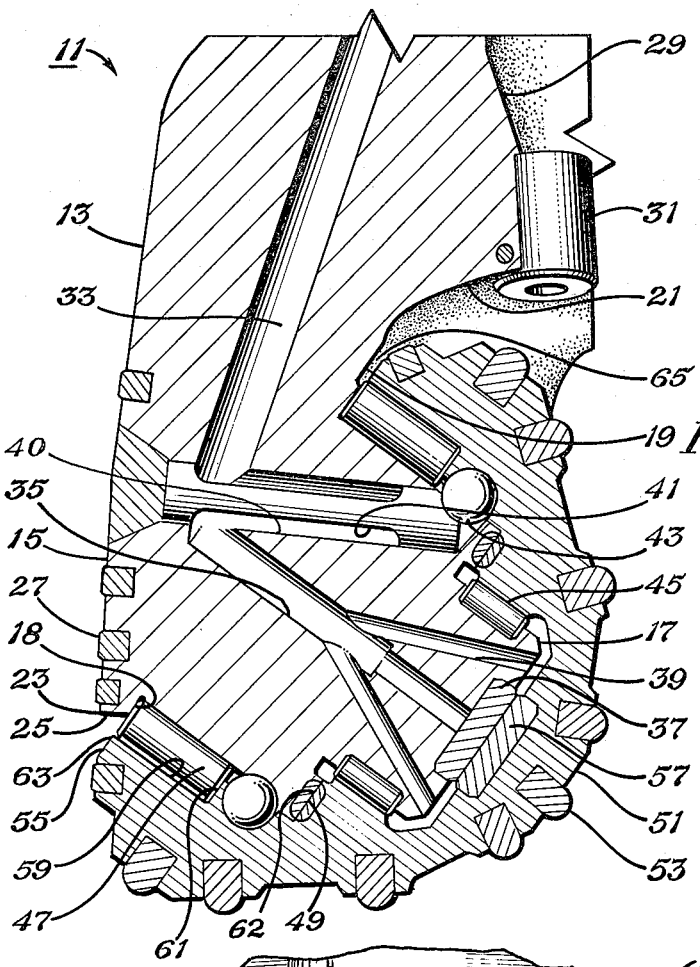
FIG. 1 is a cross-sectional view of a portion of an earth boring bit constructed in accordance with this invention.

Referring to FIG. 1, drill bit 11 is made up of three sections 13 that are assembled and subsequently welded together. Each section 13 has a bit leg 15 on its lower end. A generally cylindrical bearing pin 17 is formed on bit leg 15 and depends downwardly at a selected angle. An annular flat roller boss 18 extends around the base of bearing pin 17.

A last machined surface 19 extends outward from boss 18 on the upper side of the bearing pin 17. Last machined surface 19 is an arcuate flat surface that, like boss 18, is located in a plane perpendicular to the axis of bearing pin 17. Last machined surface 19 extends halfway around bearing pin 17. On the upper side of bearing pin 17, the last machined surface 19 extends into a crotch area or shroud 21 of the bit.

The lower extremity of bit leg 15 terminates in a shirttail 23. The lower side of boss 18 is located on the inside surface of shirttail 23. A downwardly facing edge 25 extends between the outer side of shirttail 23 and boss 18. Edge 25 extends about 180 degrees, and when viewed in cross-section as shown in FIG. 1, is about the same width as the radial width of boss 18. Edge 25 contains a line at its lowermost point that is about 22 degrees with respect to the axis of bearing pin 17.

Figure 2:
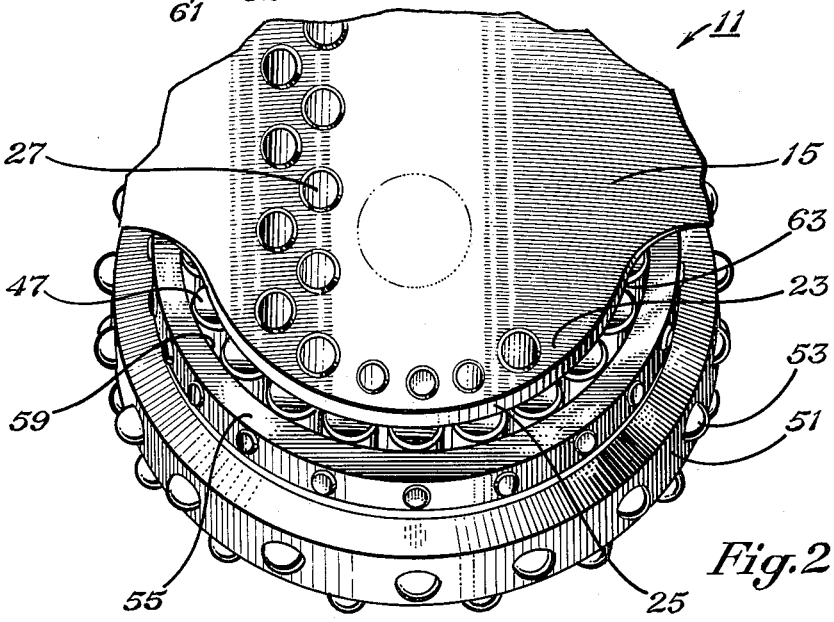
FIG. 2 is a partial side elevational view of the drill bit of FIG. 1.

A plurality of compacts or inserts 27 of hard metal such as tungsten carbide are located in the outer surface of bit leg 15. Inserts 27 are interferingly pressed into mating holes formed in the bit leg 15. As shown in FIG. 2, inserts 27 are located in a pattern that extends along the shirttail 23, then vertically upward along bit leg 15 in a general "L" configuration. Some of the inserts located at the edge of shirttail 23 are of smaller diameter than some of the other inserts.

Each section 13 has a nozzle passage 29 that extends through it. A tungsten carbide nozzle 31 is secured at the exit of the nozzle passage 29. Nozzle passage 29 leads into a central axial passage (not shown), which communicates with the interior passage of the drill pipe (not shown). Each section 13 also has a passage 33 that extends from the axial passage (not shown) of drill bit 11. A passage 35 located on the axis of bearing pin 17 intersects passage 33. Passage 35 extends to a nose button 37, which has a lateral channel means (not shown) for communicating drilling fluid pumped through passage 35 to the exterior of bearing pin 17. A plurality of passages 39 lead from passage 35 to the exterior of bearing pin 17. Drilling fluid is also delivered through a passage 40, which leads from passage 33 to a set of balls 43 that are retained by a ball plug 41.

Bearing pin 17 is of two diameters, with the smaller diameter portion being on the inner end and the larger diameter portion adjoining the bit leg 15. A set of cylindrical roller bearings 45 are also located on the smaller porton of bearing pin 17. A set of cylindrical roller bearings 47 are located on the larger portion of bearing pin 17. The smaller and larger portions of bearing pin 17 are separated by an annular shoulder 49 containing wear resistant surfaces and located in a plane perpendicular to the axis of bearing pin 17. Clearances (not shown) exist between the wear resistant surfaces at shoulder 49 for communicating fluid flowing through roller bearings 45 with roller bearings 47.

A generally conical cutter 51 is adapted to be received on bearing pin 17. Cutter 51 has a plurality of tungsten carbide inserts 53 interferingly secured in holes in its exterior for disintegrating the earth formation. Cutter 51 has a central cavity, the entrance to which is surrounded by an annular flat surface or backface 55. Backface 55 is located in a plane that is perpendicular to the axis of bearing pin 17. Backface 55 is closely spaced from the last machined surface 19 on the upper half of bearing pin 17.

A nose button 57 is located in the botom of the cavity of cutter 17 for bearing against button 37 to resist outward thrust. In the lower portion of the cavity of cutter 17, a race is formed for receiving the inner set of roller bearings 45. A cylindrical race 59 is formed in the cavity of cutter 17 for receiving the outer set of roller bearings 47. Race 59 has on its inner end an annular shoulder 61 that is perpendicular to the axis of bearing pin 17. The outer end of race 59 extends to and intersects backface 55. The length of race 59 is selected so as to place the outer ends of roller bearings 47 flush with backface 55. A shoulder 62 is formed in cutter 51 for mating with bearing pin shoulder 49. Wear resistant surfaces are located in shoulder 62.

The boss 18 is contacted by the outer ends of roller bearings 47 and prevents them from falling from cutter 51. The radial width of boss 18 is uniform and about half the diameter of the rollers 47. The outer radius of boss 18 is less than the radius of race 59. The radius of last machined surface 19 on the upper half of bearing pin 17 is greater than the diameter of race 59, and slightly greater than the outer radius of backface 55. As shown also in FIG. 2, the lower edge 25 of shirttail 23 terminates above the intersection of race 59 with backface 55. This results in an arcuate slot 63 that extends 180 degrees for discharging air passing through the roller bearings 45 and 47. Slot 63 exposes about one-half of the outer end of each roller bearing 47 on the lower side of bearing pin 17.

An arcuate clearance 65 exists on the upper side of bearing pin 17 between backface 55 and last machined surface 19. Clearance 65 is only 1/32 inch and exists for tolerance purposes, not to discharge air. Clearance 65 allows some air to be discharged, but most of all the air will be discharged through soft 63 laterally of drill bit 11 to move cuttings away from the outside surface of bit leg 15. For a 15 inch diameter bit, the cross-sectional flow area of slot 63 is about 2.4 square inches, and the flow area of clearance 65 is about 0.25 square inches. As used herein, the cross-sectional flow area of slot 63 is the area of the space between edge 25 and the corner of backface 55 with race 59, measured in a straight line. The cross-sectional flow area of clearance 65 is the space between the the last machined surface 19 and the backface 55 measured along a line parallel with the axis of bearing pin 17.

In operation, air pumped down the drill string will proceed into the drill bit. About two-thirds of the air will be discharged out the three nozzles 31. The remaining portion of the air will proceed through the passages 33, 35, 37 and 40 of each section 13. The air flows between the shoulders 49 and 62, and between balls 43 and each of the roller bearings 45 and 47. Most of the air will then exit through slot 63 into the borehole to return to the surface. Cuttings of the earth formation will be blown upward by the air flow and conveyed to the surface.

The invention has significant advantages. Increasing the dimension of the slot on the lower side of the bearing pin allows much more air to discharge into the borehole directly below the outer surface of the bit leg. This discharge aids in cleaning the borehole and preventing excessive wear on the outer surface of the bit legs. Exposing the ends of the roller bearings to the borehole greatly increases the amount of air flow in an outward and upward direction. These features can be made without extensive changes to conventional bits.

While the invention has been shown in only one of its forms, it should be apparent to those skilled in the art that it is not so limited but is susceptible to various changes and modifications without departing from the scope of the invention.

I claim:

1. In a bit for drilling a borehole in the earth having rotatable cutters mounted on bearings on bearing pins formed on the ends of bit legs, passage means extending through the bit legs and bearing pins to the bearings for transmitting drilling fluid through the bearings, the improvement comprising in combination:

annular slot means between each bit leg and each cutter for discharging into the borehole drilling fluid passing through the bearings, the annular slot means having a greater cross-sectional flow area on the lower side of the bearing pin then on the upper side of the bearing pin for discharging a greater amount of drilling fluid on the lower side than on the upper side of the bearing pin.

2. In a bit for drilling a borehole in the earth having rotatable cutters mounted on bearings on bearing pins formed on the ends of bit legs, passage means extending through the bit legs and bearing pins to the bearings for transmitting drilling fluid through the bearings, the improvement comprising in combination:

an annular slot extending around each bearing pin between each bit leg and each cutter for discharging drilling fluid passing through the bearings, the slot having a lower portion on the lower side of the bearing pin and an upper portion on the upper side of the bearing pin, the lower portion being arcuate and extending continuously around the lower edge of the bit leg, the lower portion having a greater cross-sectional flow area than the upper portion for discharging a greater amount of drilling fluid flowing through the bearings.

3. In a bit for drilling boreholes in the earth having rotatable cutters mounted on roller bearings on bearing pins that depend from bit legs, passage means extending through the bit legs and bearing pins to the roller bearings for transmitting drilling fluid through the roller bearings, an improved exit for the passage means of each bearing pin, comprising:

slot means formed in the lower end of the bit leg for exposing to the borehole about one-half the diameter of an outer end of each roller bearing when on the lower side of the bearing pin.

4. In an earth boring bit having rotatable cutters, each cutter mounted on roller bearings on a bearing pin, passage means extending through the bearing pins to the bearings for transmitting drilling fluid through the bearings, an improved exit for the passage means in each bearing pin, comprising:

a cutter having a central cavity which is encircled by an annular backface located in a plane perpendicular to the axis of the cutter, the cavity having a cylindrical portion that intersects the backface to define a corner; and a depending shirttail formed on the lower end of the bit leg and extending below the intersection of the bearing pin and bit leg, the shirttail terminating above the cylindrical portion, defining a slot with a radial width about one-half the diameter of each roller bearing for discharging drilling fluid passing through the bearings.

5. An improved earth boring bit, comprising in combination:

three head sections assembled together to define a bit body, each head section having a bit leg with a generally cylindrical bearing pin depending therefrom and formed to define an annular roller boss in the inside surface of the bit leg, the outer surface of the bit leg and the roller boss on the lower side of the bearing pin defining a depending shirttail;

a cutter having a central cavity which is encircled by an annular backface located in a plane perpendicular to the axis of the cutter, the cutter having a cylindrical race that intersects the backface;

a plurality of cylindrical roller bearings located in the race, each having a circular outer end flush with the backface and retained from further outward movement by the roller boss;

the outer radius of the roller boss on the lower side of the bearing pin being less than the radius of the race, with the shirttail terminating above the race to provide an arcuate slot between the shirttail and the race; and passage means extending through the bit leg and bearing pin to discharge drilling fluid through the slot.

* * * * *